US008495962B2

(12) United States Patent
Li

(10) Patent No.: US 8,495,962 B2
(45) Date of Patent: Jul. 30, 2013

(54) SEWING MACHINE WITH SEQUIN FEEDER DEVICE

(75) Inventor: Riquan Li, Kiyosu (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 18 days.

(21) Appl. No.: 13/116,436

(22) Filed: May 26, 2011

(65) Prior Publication Data

US 2011/0290167 A1 Dec. 1, 2011

(30) Foreign Application Priority Data

May 27, 2010 (JP) ..... 2010-122104

(51) Int. Cl.
*D05B 3/22* (2006.01)
*D05B 3/12* (2006.01)

(52) U.S. Cl.
USPC ..... 112/113

(58) Field of Classification Search
USPC ..... 112/98–101, 104, 113–115
See application file for complete search history.

(56) References Cited

U.S. PATENT DOCUMENTS

| | | | | | |
|---|---|---|---|---|---|
| 797,308 | A | * | 8/1905 | Nassberg | 112/99 |
| 3,554,148 | A | * | 1/1971 | Johnson, Jr. | 112/137 |
| 4,463,693 | A | * | 8/1984 | Dreier et al. | 112/128 |
| 4,848,253 | A | * | 7/1989 | Tajima | 112/99 |
| 4,895,088 | A | * | 1/1990 | Pirrello et al. | 112/130 |
| 5,562,057 | A | * | 10/1996 | Lenson | 112/88 |
| 5,755,168 | A | * | 5/1998 | Gunther et al. | 112/113 |

FOREIGN PATENT DOCUMENTS

JP 2004-167097 A 6/2004

* cited by examiner

*Primary Examiner* — Ismael Izaguirre
(74) *Attorney, Agent, or Firm* — Rossi, Kimms & McDowell LLP

(57) ABSTRACT

A cutting mechanism for cutting off a leading sequin from a continuous sequin strip in response to sewing operation is constructed to cut off the sequin at substantially the same time as a sewing needle pierces a sewing workpiece. For example, the cutting mechanism includes a movable cutter blade, and an abutting member that, in response to sewing operation, abuts against the movable cutter blade to move the movable cutter blade in a predetermined direction so that the sequin is cut off by the movable cutter blade. The abutting member is provided in a presser foot that presses down the sewing workpiece in interlocked relation to the sewing needle during the sewing operation.

3 Claims, 5 Drawing Sheets

SEWING MACHINE WITH SEQUIN FEEDER DEVICE

BACKGROUND

The present invention relates to sewing machines that are provided with a sequin feeder device and that sew sequins onto a sewing workpiece while severing or cutting sequins from a ribbon or strip of continuously-connected sequins (hereinafter referred to as "continuous sequin strip"), and more particularly to a technique for accelerating timing for cutting off a sequin from the continuous sequin strip.

One example of sequin feeder devices for use in sewing machines is known from Japanese Patent Application Laid-open Publication No. 2004-167097. The conventionally-known sequin feeder device disclosed in the No. 2004-167097 publication includes a feed mechanism for feeding a continuous sequin strip, by a predetermined pitch corresponding to a size of one sequin at a time. FIG. 9 shows the conventionally-known sequin feeder device with the feed mechanism in enlarged scale. The conventionally-known sequin feeder device pays out or lets out a continuous sequin strip 50 from a reel having the continuous sequin strip 50 wound thereon, then places a leading portion of the continuous sequin strip 50 on the upper surface of a support plate 51, then feeds out the leading portion of the continuous sequin strip 50 by a predetermined pitch through advancing and retracting movement of a feed lever 52, and then sews one sequin onto a sewing workpiece H while cutting off the sequin from the continuous sequin strip 50.

In the sewing machine provided with the conventionally-known sequin feeder device, cutting-off of the sequin is effected through cooperation between a movable cutter blade 54 pivotably disposed on an end portion of the support plate 51 and a fixed cutter blade 55 fixedly disposed on the end portion of the support plate 51. As a needle bar 53 descends in response to sewing operation, a sewing needle 56 passes through a needle passage hole of a fed-out sequin, after which a needle clamp 57 abuts against the movable cutter blade 54. FIG. 10 shows the needle clamp 57 having brought into abutting engagement with the movable cutter blade 54. As the needle bar 53 further descends from the state shown in FIG. 10, the movable cutter blade 54 is caused to pivot, so that the sequin is cut off from the continuous sequin strip 30 slightly before the needle bar 53 reaches its bottom dead point. Namely, the sequin is cut off at a stage where the sewing needle 56 has pierced the sewing workpiece H to a considerable degree as shown in FIG. 10. The thus-cut-off sequin falls onto the sewing workpiece H by being guided by the sewing needle 56 passed through the needle passage hole of the cut-off sequin, and then it is sewn onto the sewing workpiece H through subsequent sewing operation.

Namely, in the sewing machine provided with the conventionally-known sequin feeder device, the sequin is cut off from the continuous sequin strip near the bottom dead point of the needle bar when the sewing needle has passed deeply through the needle passage hole of the sequin. At that time, the sewing needle or a sewing thread passed through the sewing needle may undesirably contact the peripheral edge of the needle passage hole of the sequin due to vibration of the sewing machine, deformation of the sewing needle caused as the needle pierces the sewing workpiece, etc. If the sewing needle, descends with the sewing needle or sewing thread contacting the peripheral edge of the needle passage hole of the sequin, the fed-out sequin may be undesirably pressed downward together with the sewing thread as shown in FIG. 11. Consequently, the continuous sequin strip would be let out or pulled out excessively, so that, an actual sequin cutting position of the sequin strip would be undesirably deviated from a predetermined sequin cutting position. Further, if the sewing needle descends with the sewing thread kept contacting the peripheral edge of the needle passage hole of the sequin, the sewing thread would scrape against the peripheral edge of the needle passage hole of the sequin, so that the sewing thread may undesirably get frayed or broken. Particularly, in a case where the sequin to be sewn is of a small size, the needle passage hole of the sequin would naturally have a small diameter or size, and thus, the aforementioned inconveniences tend to occur easily.

SUMMARY OF THE INVENTION

In view of the foregoing, it is an object of the present invention to provide an improved sewing machine provided with a sequin feeder device which can reliably prevent deviation of a cutting position of a continuous sequin strip and prevent a sewing thread from getting frayed and broken.

In order to accomplish the above-mentioned object, the present invention provides an improved sewing machine, which comprises: a sequin feeder device for feeding a continuous sequin strip, by a predetermined pitch corresponding to a size of a sequin at a time, toward a predetermined cutting position; and a cutting mechanism for cutting off a leading sequin from the continuous sequin strip after a sewing needle passes through a needle passage hole of the leading sequin, the cutting mechanism being constructed to cut off the sequin at substantially the same time as the sewing needle pierces a sewing workpiece.

Because the sewing machine of the present invention is constructed in such a manner that the sequin is cut off at substantially the same time as the sewing needle pierces the swing workpiece, the sequin is cut off from the continuous sequin strip at an early time point after the sewing needle passes through the needle passage hole of the sequin. Thus, even when the sewing needle or a sewing thread is contacting the peripheral edge of the needle passage hole of the sequin, the sequin can be cut off immediately and displaced to a position where unwanted contact between the peripheral edge of the needle passage hole of the sequin and the sewing needle or the sewing thread is avoided. Thus, even when the sewing needle or the sewing thread contacts the peripheral edge of the needle passage hole of the sequin, it is possible to minimize the time when the sewing needle or the sewing thread is held in contact with the peripheral edge of the needle passage hole of the sequin. As a consequence, the present invention can prevent the continuous sequin strip from being pulled out excessively and deviated from a predetermined cutting position. Also, the present invention constructed in the aforementioned manner can prevent the sewing thread from getting frayed and broken.

The following will describe embodiments of the present invention, but it should be appreciated that the present invention is not limited to the described embodiments and various modifications of the invention are possible without departing from the basic principles. The scope of the present invention is therefore to be determined solely by the appended claims.

DETAILED DESCRIPTION

Figure 1:
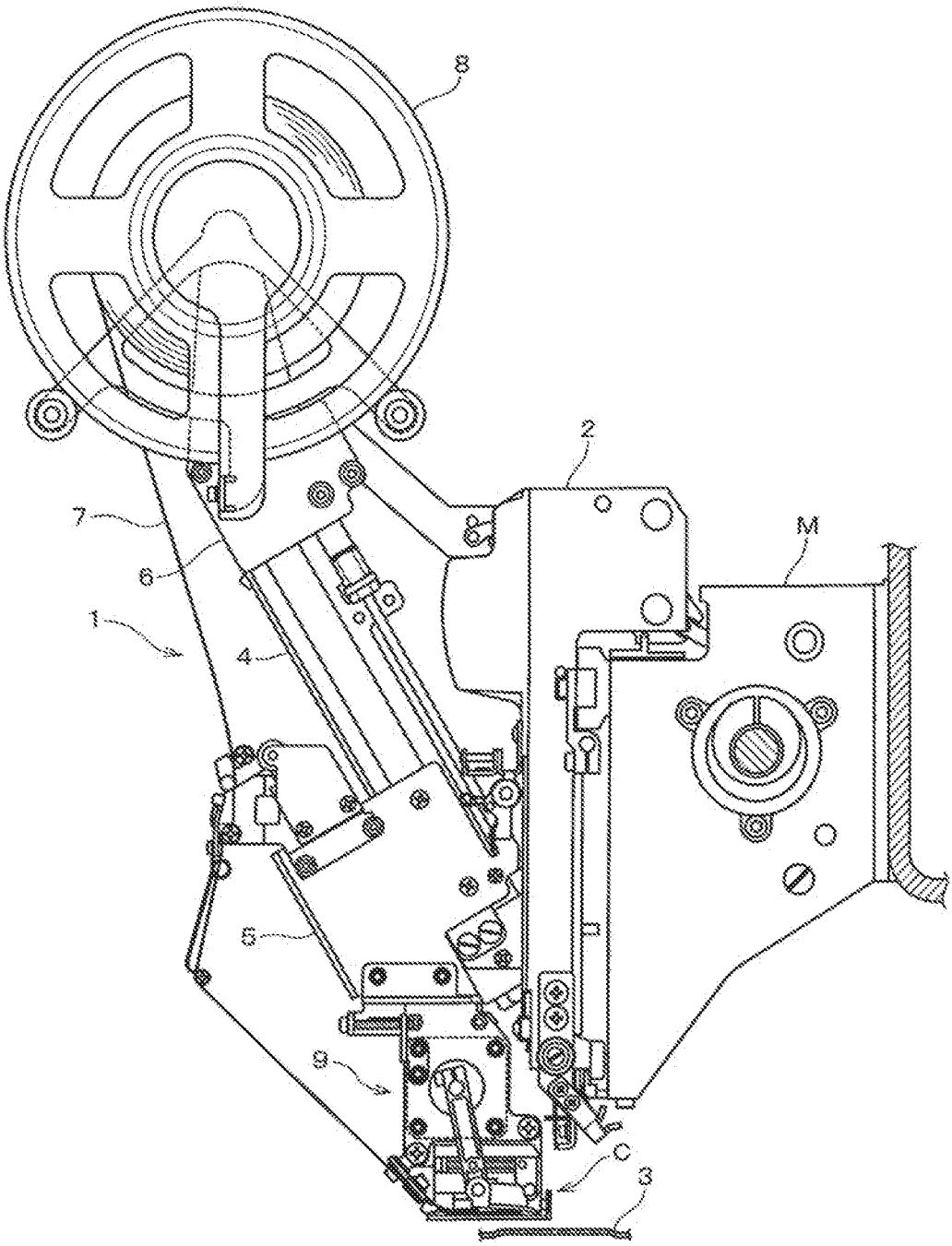
FIG. 1 is a right side view showing an example of a sequin feeder unit or device employed in a sewing machine according to an embodiment of the present invention.

FIG. 1 is a right side view showing an example of a sequin feeder unit or device 1 employed in a sewing machine according to an embodiment of the present invention. As shown in FIG. 1, the sewing machine includes a machine head M, a needle case 2 and a needle plate 3. In the illustrated example of FIG. 1, the sequin feeder unit or device 1 is provided only on the left side of the needle case 2, although the sequin feeder unit or device 1 may be provided on the right side or on both of the left and right sides of the needle case 2. The needle bar case 2 is of a multi-needle structure, and, in the case where the sequin feeder unit 1 is fixed to the left side of the needle bar case 2 as in the illustrated example, the leftmost needle in the needle bar case 2 is used as a sequin sewing needle.

The sequin feeder unit 1 includes a base 4 fixed to the left side surface of the needle bar case 2, and a mounting base 5 mounted on the base 4 in such a manner that it can move up and clown (i.e., ascend and descend) along the base 4. An upper bracket 6 is fixed to an upper portion of the base 4, and a reel 8 having a continuous sequin strip 7 wound thereon is supported on the upper bracket 6. A sequin feed mechanism 9 for feeding out a sequin is provided on the mounting base 5.

Figure 2:
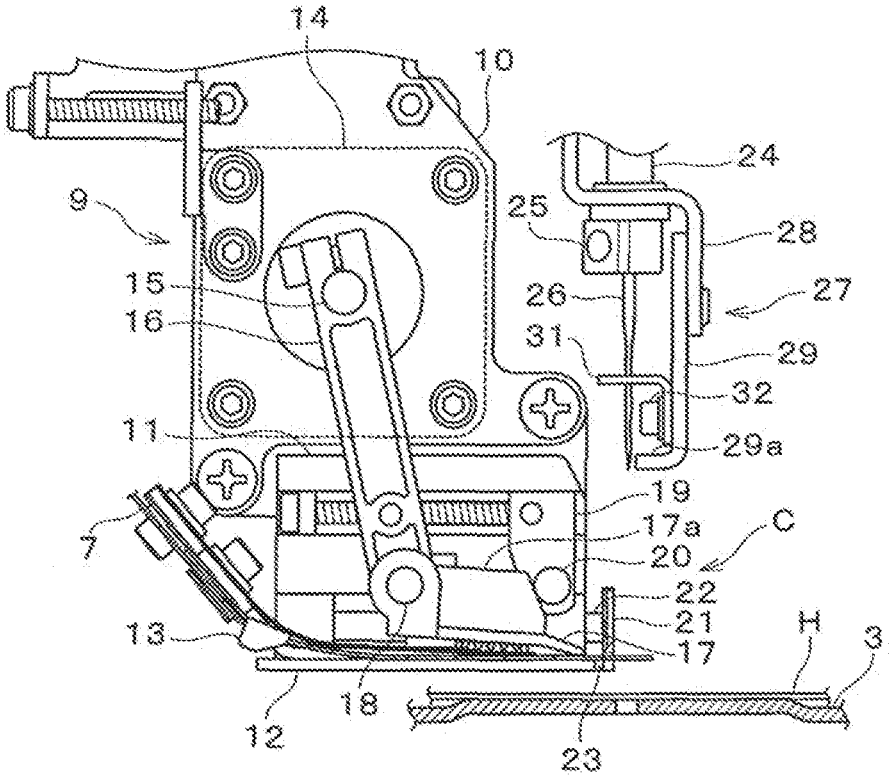
FIG. 2 is a side view showing in enlarged scale a sequin feed mechanism shown in FIG. 1.
Figure 3:
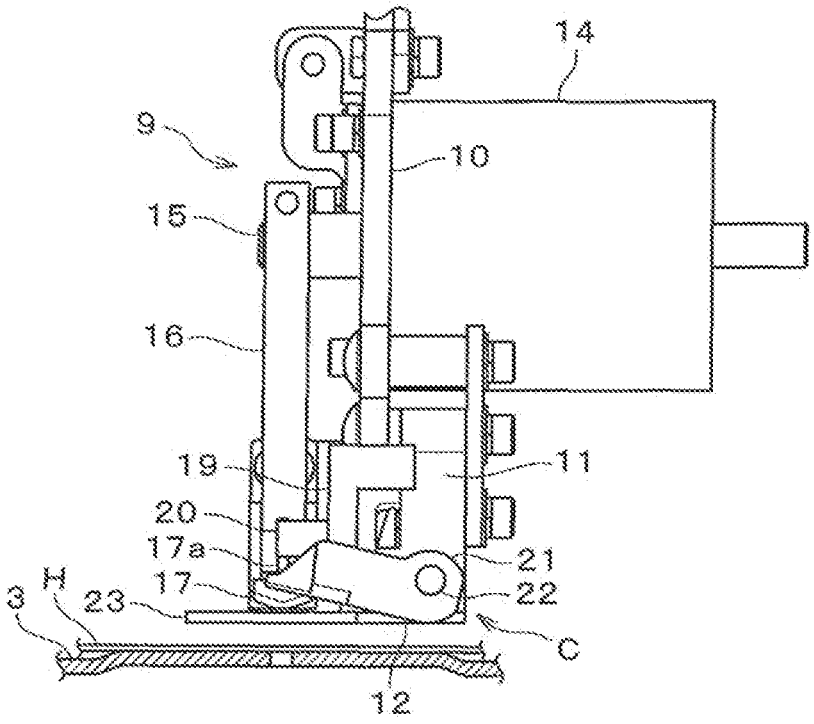
FIG. 3 is a rear view of the sequin feed mechanism shown in FIG. 2.

FIG. 2 is a side view showing in enlarged scale the sequin feed mechanism 9, and FIG. 3 is a rear view of the sequin feed mechanism 9. The sequin feed mechanism 9 includes a support plate 10 fixed underneath the mounting base 5, and a support block 11 fixed underneath the support plate 10. A supporting plate 12 is provided horizontally on the underside of the support block 11 for supporting thereon the continuous sequin strip 7. The continuous sequin strip 7 paid out from the reel 8 is directed or guided onto the supporting plate 12 via a plurality of guide members and a guide member 13 provided on the sequin feed mechanism 9.

A motor 14 is fixed to the support plate 10, and a pivot arm 16 is fixed to a shaft of the motor 14. A feed lever 17 is pivotably supported, via a shaft 18, on a distal end portion of the pivot arm 16. By a not shown torsion spring, the feed lever 17 is normally biased in such a direction where its distal end contacts the supporting plate 12. By the motor 14, the pivot arm 16 is driven to reciprocatively pivot over a predetermined angular range so that the feed lever 17 advances and retracts (i.e., moves forward and rearward). In this manner, the sequin feed mechanism 9 performs sequin feeding operation.

Further, a regulation member 19 is provided on the support block 11, and the regulation member 19 has a pin 20 fixed thereto that, upon completion of the sequin feeding operation, abuts against an abutting piece 17*a* of the feed lever 17 to thereby prevent uplift of the distal end of the feed lever 17.

A movable cutter blade 21 is pivotably supported via a pin 22 on a lower end portion of the support block 11, and this movable cutter blade 27 is normally biased upwardly via a not shown torsion spring so that it is normally retained in an evacuated position as shown in FIG. 3. Further, a fixed cutter blade 23 for cutting off a sequin in conjunction with the movable cutter blade 21 is provided at an end edge of the supporting plate 12 (namely, provided in a predetermined cutting position). The movable cutter blade 21, fixed cutter blade 23 and later-described abutting member 31 together constitute a cutting mechanism C.

Figure 4:
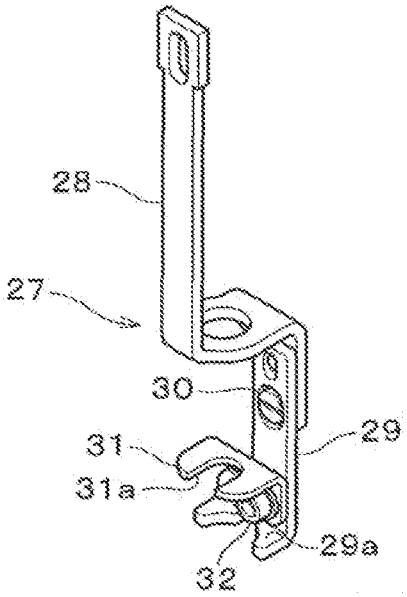
FIG. 4 is a perspective view showing in enlarged scale an example of a presser foot employed in the sewing machine.

In FIG. 2, reference numeral 24 indicates the leftmost needle bar in the needle bar case 2, and a sewing needle 26 is fixed to the lower end of the needle bar 24 via a needle clamp 23. Reference numeral 27 indicates a conventional-type presser foot that is moved up and down in response to sewing operation of the sewing machine and that, as the sewing needle 26 pierces a sewing workpiece H, reaches its bottom dead point to press down the sewing workpiece H. As well known in the art, a vertical (up-down) movement range of the sewing needle 26 (needle bar 24) and a vertical (up-down) movement range of the presser foot 27 differ from each other, and the bottom dead point of the presser foot (pressing member) 27 is located higher than a bottom dead point of the sewing needle 26 (needle bar 24). FIG. 4 is a perspective view of the presser foot 27. The presser foot 27 comprises a base member 28 and a sewing workpiece pressing member 29, and the sewing workpiece pressing member 29 is fixed to a lower end portion of the base member 28 by means of a screw 30. The sewing workpiece pressing member 29 has a pressing section 29*a* provided on its lower end portion, and this pressing section 29*a* has a semicircular escape portion formed therein to avoid interference with a sequin to be sewn. Note that the sewing workpiece pressing member 29 is replaceable with another one in accordance with a size of a sequin to be sewn. The abutting member 31 capable of abutting against the movable cutter blade 21 is fixed to the sewing workpiece pressing member 29 by means of a screw 32. The abutting member 31 has a recess 31*a* to permit passage therethrough of the sewing needle 26.

As the presser foot 27 descends together with the needle bar 24 in response to sewing operation of the sewing machine, the abutting member 31 abuts against an upper end portion of the movable cutter blade 21 to urge or move the movable cutter blade 21 downward. Thus, the movable cutter blade 21 pivots downwardly against the biasing force of the torsion spring and thereby cut off a leading sequin from the continuous sequin strip 7. A height of the abutting member 31 in the sewing workpiece pressing member 29 is set appropriately in such a manner that the cutting-off of the leading sequin is effected at substantially the same time as the presser foot 27 reaches the bottom dead point and the sewing needle 26 pierces the swing workpiece H. The abutting member 31 has a vertically-elongated mounting hole such that a mounted position of the abutting member 31 in the sewing workpiece pressing member 29 is appropriately vertically adjustable, so that the leading sequin can be cut off at substantially the same time as the sewing needle 26 pierces the swing workpiece H. Note that, as the presser foot 27 ascends together with the needle bar 24, the movable cutter blade 21 returns back to the original evacuated position through the biasing force of the torsion spring.

Next, a detailed description will be given about a manner in which a sequin is cut off in the instant embodiment of the sewing machine. FIG. 2 shows a state of the sewing machine when the feeder device has completed operation for feeding out one sequin, in which one sequin at the leading end of the continuous sequin strip 7 (i.e., leading sequin) projects forward beyond the supporting plate 12. In this state, the instant embodiment of the sewing machine behaves as follows by descending movement of the sewing needle 26 and presser foot 27.

Figure 5:
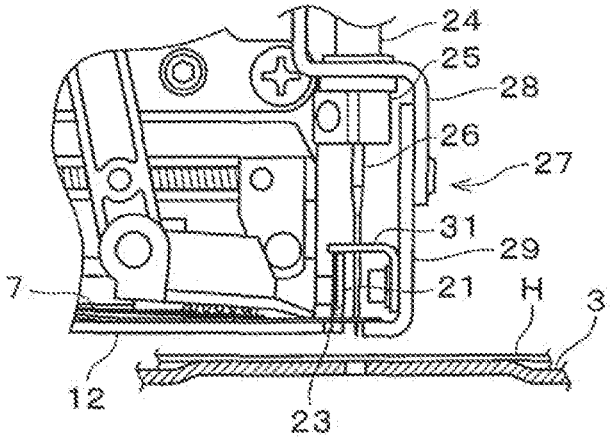
FIG. 5 is a side view of the sequin feed mechanism, which particularly shows an abutting member of the presser foot contacting a movable cutter blade after a sewing needle passes through a needle passage hole of a sequin.
Figure 6:
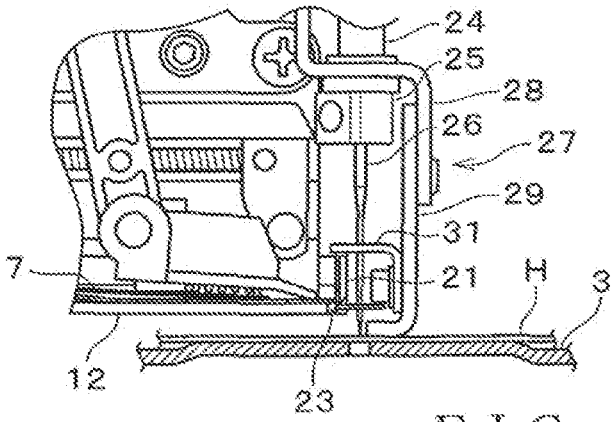
FIG. 6 is a side view of the sequin feed mechanism, which particularly shows a manner in which the sequin is cut off from a continuous sequin strip at substantially the same time as the sewing needle pierces a sewing workpiece.

First, after the descending sewing needle 26 passes through the needle passage hole of the sequin, the abutting member 31 of the sewing workpiece pressing member 29 abuts against, the upper end portion of the movable cutter blade 21 as shown in FIG. 5. Then, as the sewing needle 26 and the presser foot 27 further descend from the aforementioned state, the movable cutter blade 21 pivots downwardly so that the sequin is cut off from the continuous sequin strip 7 at substantially the same time as the sewing needle 26 pierces the swing workpiece H is shown in FIG. 6. Then, the cut-off sequin falls onto the sewing workpiece H with the sewing needle 26 kept passed through the needle passage hole of the sequin, so that the sequin is sewn onto the swing workpiece through subsequent sewing operation. The above phrase "the sequin is cut off from the continuous sequin strip 7 at substantially the same time as the sewing needle 26 pierces the swing workpiece H" of course means that the sequin is cut off from the continuous sequin strip 7 at the same time as the sewing needle 26 starts piercing the swing workpiece H, but also means that the sequin is cut off from the continuous sequin strip 7 slightly for at appropriate timing) before the sewing needle 26 starts piercing the swing workpiece H or that the sequin is cut off from the continuous sequin strip 7 slightly for at appropriate timing) after the sewing needle 26 starts piercing the swing workpiece H.

Because the instant embodiment is constructed in such a manner that the sequin is cut off at substantially the same time as the sewing needle 26 pierces the swing workpiece H, the sequin is cut off from the continuous sequin strip 7 at an early time point after the sewing needle 26 passes through the needle passage hole of the sequin. Thus, even when the sewing needle 26 or a sewing thread passed through the sewing needle 26 is contacting the peripheral edge of the needle passage hole of the sequin, the sequin can be cut off immediately and displaced to a position where unwanted contact between the peripheral edge of the needle passage hole of the sequin and the sewing needle 26 or the sewing thread passed through the sewing needle 26 is avoided. Thus, even when the sewing needle 26 or the sewing thread passed through the sewing needle 26 contacts the peripheral edge of the needle passage hole of the sequin, it is possible to minimize the length of the time when the sewing needle 26 or the sewing thread passed through the sewing needle 26 is held in contact with the peripheral edge of the needle passage hole of the sequin. As a consequence, the instant embodiment can prevent the continuous sequin strip 7 from being pulled out excessively and deviated from a predetermined cutting position. Also, the instant embodiment can prevent the sewing thread from getting frayed and broken. Further, because the instant embodiment of the sewing machine is constructed in such a manner that the cutting-off of the leading sequin is effected at substantially the same time as the sewing needle 26 pierces the swing workpiece H, the instant embodiment allows the cut-off sequin to reliably fall onto the swing workpiece H with the sewing needle 26 still kept passed through the needle passage hole of the sequin. Thus, the instant embodiment can completely prevent the prior art problems, such as deviation of the cut-off sequin from a needle drop position, thereby allowing the cut-off sequin to be reliably sewn onto the sewing workpiece H.

Figure 7:
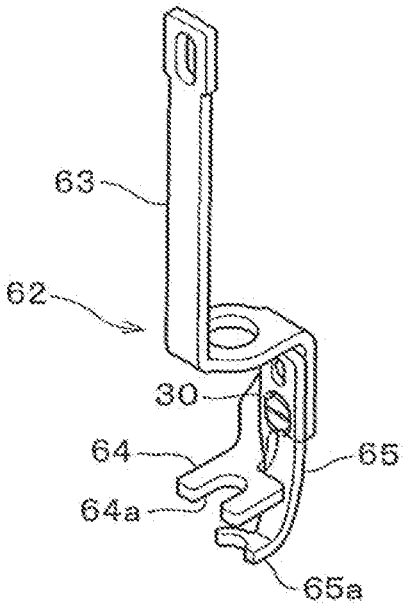
FIG. 7 is a perspective view showing in enlarged scale another example of the presser foot.

FIG. 7 is a perspective view of another embodiment employing a modification or another example of the presser foot (modified presser foot) 62. This modified presser foot 62 too comprises a base member 63 and a sewing workpiece pressing member 65, and the sewing workpiece pressing member 65 is fixed to a lower end portion of the base member 63 by means of the screw 30. The sewing workpiece pressing member 65 is designed to be used for a sequin of a smaller size (e.g., diameter of 4 mm or less), and the sewing workpiece pressing member 65 has a pressing section 65*a* provided on its lower end portion, and this pressing section 65*a* has a semicircular escape portion formed therein to avoid interference with a sequin to be sewn. The modified presser foot 62 further includes an abutting member 64 formed on a lower end portion of the base member 63 and capable of abutting against the movable cutter blade 21, and the abutting member 64 has a recess 64*a* to permit passage therethrough of the sewing needle 26.

The modified presser foot 62 shown in FIG. 7 is different from the presser foot 27 shown in FIG. 4 in that the abutting member 64 is formed on the lower end portion of the base member 63. However, the instant embodiment of the sewing machine employing the modified presser foot 62 can perform the same sequin cutting operation and achieve the same advantageous benefits as the above-described embodiment. However, the presser foot 62 shown in FIG. 7 can achieve the following advantageous benefits over the presser foot 27 shown in FIG. 4.

In each of the presser foot 27 and presser foot 62 shown in FIGS. 4 and 7, the sewing workpiece pressing member 29 or 65 is fixed to the base member 28 or (33 in such a manner that it is adjustable in vertical position (height position) in accordance with the thickness of the sewing workpiece H etc. With the presser foot 27 shown in FIG. 4, where the abutting member 31 is fixed to the sewing workpiece pressing member 29, the height position of the abutting member 31 too will be changed as the height position of the sewing workpiece pressing member 29 is changed, so that the sequin cutting timing will also change. Thus, when the height position of the sewing workpiece pressing member 29 has been changed, there arises a need to adjust the sequin cutting timing by adjusting the height position of the abutting member 31. On the other hand, with the presser foot 62 shown in FIG. 7, where the abutting member 31 is formed on the lower end portion of the base member 63, the sequin cutting timing will not change even when the height position of the sewing workpiece pressing member 65 has been changed. Thus, even when the height position of the sewing workpiece pressing member 65 has been changed, there is no need to adjust the sequin cutting timing. Note that, if the sequin cutting timing is to be adjusted in the sewing machine employing the presser foot 62 shown in FIG. 7, the height position of the base member 63 is adjusted.

Whereas each of the embodiments has been described above in relation to the case where the abutting member 31 or 64 has the recess 31*a* or 64*a* to permit passage therethrough of the sewing needle 26, such a recess 31*a* or 64*a* may be replaced with a hole or any other suitable means for permitting passage therethrough of the sewing needle. Further, the sequin feeder unit 1 is not limited to the above-described construction and may be constructed in any conventionally-known manner.

Figure 8:
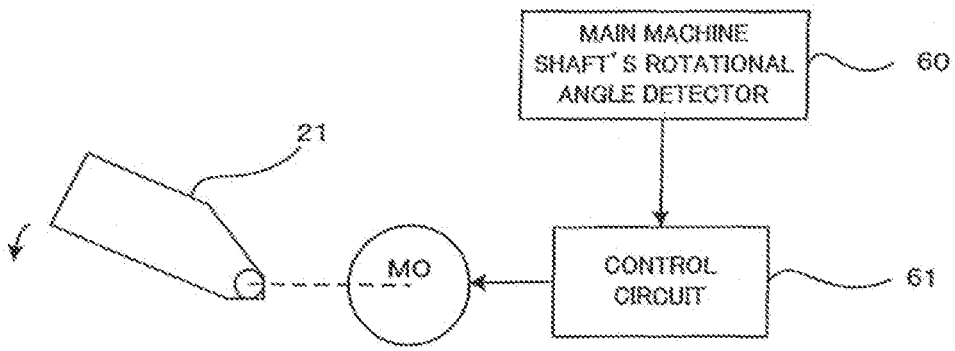
FIG. 8 is a schematic diagram showing another example of a cutting mechanism employed in the sewing machine.
Figure 9:
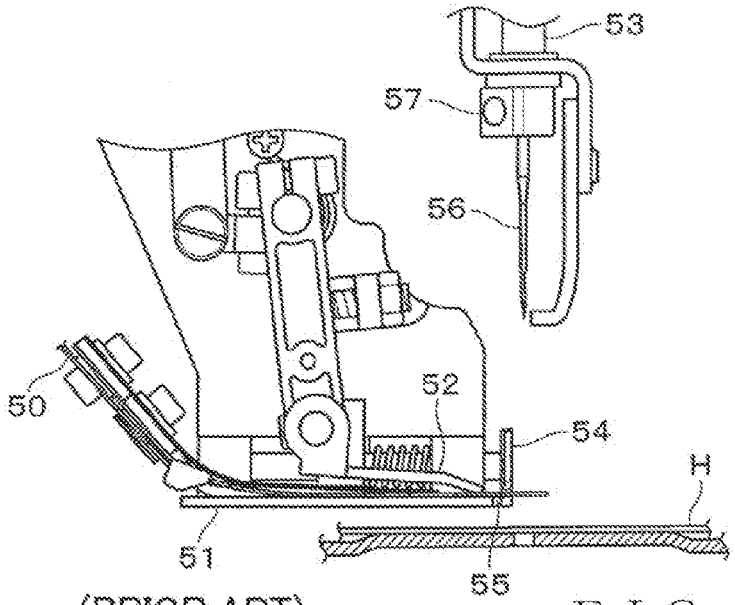
(PRIOR ART) F I G. 9
FIG. 9 is a side view showing in enlarged scale a feed mechanism of a conventionally-known sequin feeder device.
Figure 10:
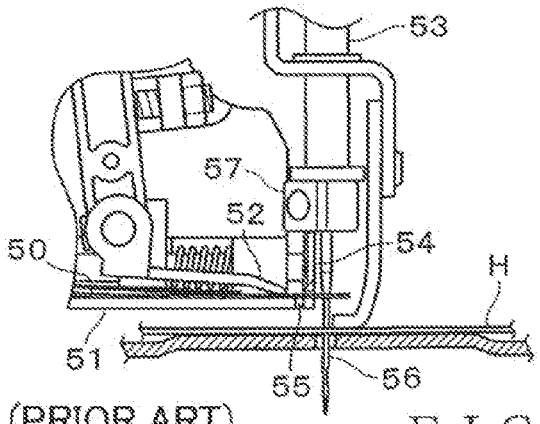
(PRIOR ART) F I G. 10
FIG. 10 is a side view showing behavior of the conventionally-known sequin feeder device shown in FIG. 9.
Figure 11:
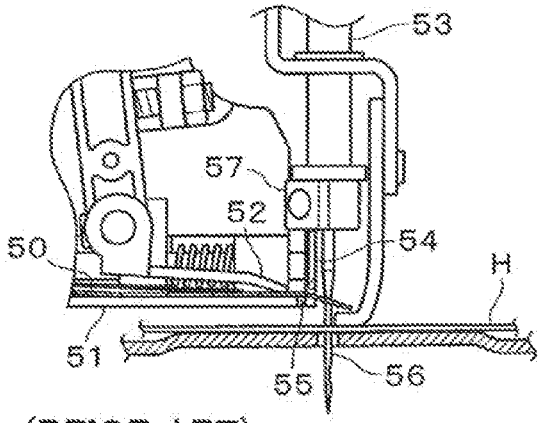
(PRIOR ART) F I G. 11
FIG. 11 is a side view showing behavior of the conventionally-known sequin feeder device shown in FIG. 9.

Further, whereas the embodiments have been described above in relation to the case where the movable cutter blade 21 is vertically pivotably supported in such a manner that a sequin can be cut off by downward pivoting movement of the movable cutter blade 21 (i.e., by the movable cutter blade 21 being driven downwardly), the present invention is not so limited, and the movable cutter blade 21 may be moved in any other suitable manner; for example, the movable cutter blade 21 may be slid vertically or laterally. As another example, a separate drive source may be provided for pivoting the movable cutter blade 21. FIG. 8 is a schematic diagram showing an example of such a construction, where the movable cutter blade 21 is constructed to be pivoted by an electric motor MO. In the example of FIG. 8, a main machine shaft's rotational angle detector 60 for detecting a rotational angle of a main shaft of the sewing machine detects a position of the sewing needle 26, and a control circuit 61 controls activation (driving operation) of the electric motor MO on the basis of detected sewing needle position data in such a manner that the movable cutter blade 21 is driven to cut off a sequin at substantially the same time as the sewing needle 26 pierces the sewing workpiece H.

This application is based on, and claims priority to JP PA 2010-122104 filed on 27 May 2010. The disclosure of the priority application, in its entirety, including the drawings, claims, and the specification thereof, is incorporated herein by reference.

What is claimed is:

1. A sewing machine comprising:

a sequin feeder device for feeding a continuous sequin strip, by a predetermined pitch corresponding to a size of a sequin at a time, toward a predetermined cutting position; and a cutting mechanism for cutting off a leading sequin from the continuous sequin strip after a sewing needle passes through a needle passage hole of the leading sequin, said cutting mechanism being constructed to cut off the sequin at substantially the same time as the sewing needle pierces a sewing workpiece;

wherein said cutting mechanism includes a movable cutter blade disposed in the predetermined cutting position, and an abutting member that, in response to sewing operation, abuts against said movable cutter blade to move said movable cutter blade in a predetermined direction so that the sequin is cut off by said movable cutter blade, and wherein said abutting member is provided in a presser foot that presses down the sewing workpiece in interlocked relation to the sewing needle during the sewing operation.

2. The sewing machine as claimed in claim 1, wherein the predetermined direction in which said movable cutter blade is moved by said abutting member is a downward or lateral direction.

3. The sewing machine as claimed in claim 1, wherein said cutting mechanism includes: a movable cutter blade disposed in the predetermined cutting position; a motor for driving said movable cutter blade; and a control device for controlling driving operation of said motor on the basis of a detected position of the sewing needle in such a manner that the sequin is cut off at substantially the same time as the sewing needle pierces the sewing workpiece.

* * * * *